US006546224B2

(12) United States Patent
Saito

(10) Patent No.: US 6,546,224 B2
(45) Date of Patent: Apr. 8, 2003

(54) WET-TYPE PRINTING APPARATUS HAVING A CLEANER

(75) Inventor: Mitsunaga Saito, Chiba (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/895,024

(22) Filed: Jul. 2, 2001

(65) Prior Publication Data

US 2002/0001493 A1 Jan. 3, 2002

(30) Foreign Application Priority Data

Jun. 30, 2000 (JP) ..... 2000-199938

(51) Int. Cl.[7] ..... G03G 21/00
(52) U.S. Cl. ..... 399/348; 399/352; 399/353
(58) Field of Search ..... 399/34, 343, 345, 399/348, 352, 353; 15/256.5, 256.51

(56) References Cited

U.S. PATENT DOCUMENTS 4,110,035 A 8/1978 Kamata ..... 399/352
5,452,065 A * 9/1995 Bell ..... 399/325
5,797,063 A * 8/1998 Umezawa et al. ..... 399/352 R
5,842,103 A * 11/1998 Swift ..... 399/353
5,911,101 A * 6/1999 Park ..... 399/345
5,915,152 A * 6/1999 Meiri et al. ..... 399/246
5,933,689 A * 8/1999 Kim ..... 399/233
6,041,211 A 3/2000 Hobson et al. ..... 399/352
6,195,527 B1 * 2/2001 Ziegelmuller et al. ..... 399/352

FOREIGN PATENT DOCUMENTS

JP 4-16978 * 1/1992

* cited by examiner

*Primary Examiner*—Hoan Tran
(74) *Attorney, Agent, or Firm*—Oblon, Spivak, McClelland, Maier & Neustadt, P.C.

(57) ABSTRACT

A printing apparatus for printing an image onto a print medium with use of a liquid developer which contains a liquid carrier and a toner being dispersed in the liquid carrier. The printing apparatus has: an image holding member having an imaging surface on which a latent image corresponding to the image to be printed is generated; a development unit which provides the liquid developer to the imaging surface to form a toner image corresponding to the latent image; a transfer member which transfers the toner image from the imaging surface to the print medium; and a fibrous wipe member having a cleaning face contacting with the imaging surface for wiping a residual toner failing to be transferred from the imaging surface by moving relatively to the imaging surface in a first direction. A cleaning liquid is impregnated at a ratio of 2 grams per square meter to 200 grams per square meter in the fibrous wipe member.

14 Claims, 1 Drawing Sheet

WET-TYPE PRINTING APPARATUS HAVING A CLEANER

BACKGROUND OF THE INVENTION

1. Field of the Invention

The present invention relates to a printing apparatus, and, more particularly to a wet-type printing apparatus having a cleaner that is used for cleaning residual toner particles after transferring an image developed by using a liquid developer containing a carrier solution and toner particles.

2. Related Art

Printing apparatuses such as electronic photograph recording apparatuses and electrostatic recording apparatuses are classified into those of a dry-type and a wet-type. The printing apparatuses of the wet-type which use a liquid developer have advantages that cannot be achieved by those of the dry-type, and in recent years, its advantages have been re-confirmed.

The advantages of the wet-type printing apparatus over the dry-type printing apparatus are explained as follows:

1) The application of a liquid developer makes it possible to use very fine toner particles in the order of sub-micron size, and consequently to achieve high-quality images.
2) Since a high-density image is obtained by using only a small amount of toner, it is advantageous from the viewpoint of costs, and it is also possible to realize image quality as good as that obtained through an offset printing process or other like printing process.
3) Since the toner is fixed onto paper at comparatively low temperatures, it is possible to save energy.

However, some of inherent problems with the wet-type printing apparatus have been left unsolved, and for this reason, in the technical field of conventional printing apparatuses, the dry-type printing apparatuses have monopolized the market for a long time. One of the unsolved problems relates to cleaning means, and, more specifically, lies in the fact that a cleaning process for residual toner after a transferring process is more difficult than that of the dry-type printing apparatus.

The particle size of toner particles used in the liquid developer ranges approximately from 0.1 micron to 3 microns, which is smaller than the size of dry-type toner particles. For this reason, in an attempt to apply a cleaning system having scraping blades used in the dry-type printing apparatus to the wet-type printing apparatus, an insufficient cleaning process causing black lines, etc., tends to occur. In order to prevent this from occurring, it is necessary to make the scraping precision of the blades higher. However, it is difficult to achieve this from the practical point of view, and it is also difficult to maintain such high precision.

Under the above circumstances, in the cleaning device of the conventional wet-type printing apparatus, a method has been proposed, in which a great amount of liquid solvent is supplied to the residual toner after a transferring process to allow the toner particles to disperse in the liquid solvent so that the toner is removed together with the liquid solvent by using a roller or a blade (ref. Japanese Examined Patent Publication No. 63-4117). However, in this method, complicated mechanisms are required for supplying and recovering the liquid solvent, which causes the problems of a bulky cleaning device, frequent occurrences of troubles, and high production costs.

As described above, in the conventional printing apparatus using a liquid developer, the attempt to properly clean the residual toner after a transferring process results in problems of difficulty in practical use, complex and bulky devices and increased causes of troubles.

BRIEF SUMMARY OF THE INVENTION

With these problems in mind, therefore, it is the primary object of the present invention to provide a novel printing apparatus using a liquid developer, in which a cleaning of residual toner after a transferring process is completely carried out to keep the surface of an image holding member in a good condition and to form an image with high image quality.

In order to achieve the above-mentioned object, a printing apparatus for printing an image onto a print medium with use of a liquid developer which contains a liquid carrier and a toner being dispersed in the liquid carrier, according to an aspect of the present invention comprises; an image holding member having an imaging surface on which a latent image corresponding to the image to be printed is generated; a development unit which provides the liquid developer to the imaging surface to form a toner image corresponding to the latent image: a transfer member which transfers the toner image from the imaging surface to the print medium; and a fibrous wipe member having a cleaning face contacting with the imaging surface for wiping a residual toner failing to be transferred from the imaging surface, by moving relatively to the imaging surface in a first direction, wherein the cleaning face comprises fibers having a directional distribution which is biassed to a second direction perpendicular to said first direction.

BRIEF DESCRIPTION OF THE SEVERAL VIEWS OF THE DRAWINGS

The features and advantages of the printing apparatus according to the present invention over the proposed apparatuses will be more clearly understood from the following description of the embodiments of the present invention taken in conjunction with the accompanying drawings in which like reference numerals designate the same or similar elements or sections throughout the figures thereof and in which.

DETAILED DESCRIPTION OF THE INVENTION

Figure 1:
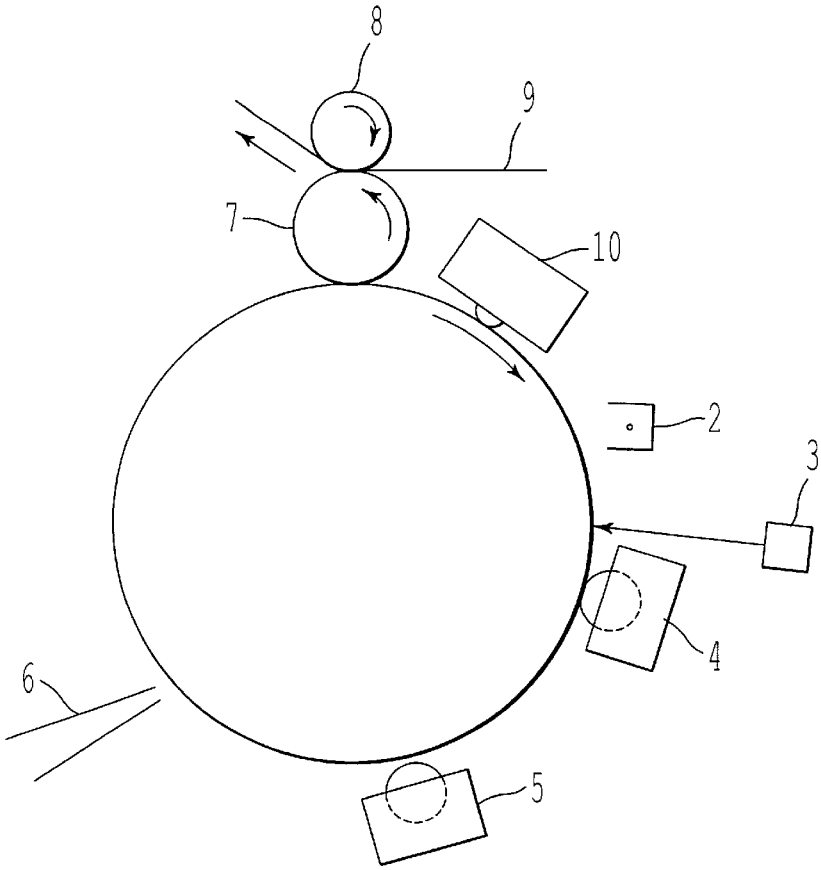
FIG. 1 is a schematic view showing the structure of a printing apparatus using a liquid developer according to an embodiment of the present invention.

Referring now to the drawings, the following description will discuss a printing apparatus using a liquid developer according to embodiments of the present invention.

FIG. 1 is a schematic view showing the structure of an embodiment of the printing apparatus according to the present invention, and this apparatus is a wet-type printing apparatus using an electrophotographic process.

The printing apparatus of FIG. 1 comprises a image holding member 1 having a photosensitive layer on the surface thereof, and a toner image is formed on the photosensitive layer of the image holding member 1 by using a liquid developer. In FIG. 1, the image holding member 1 is constructed as a photosensitive drum having a cylinder shape, and constituted by an electroconductive rigid base having a cylinder shape and made of an electroconductive material such as aluminum or the like and a photosensitive layer made from an organic or amorphous silicon photosensitive material that is formed on the surface of the rigid base. In order to prevent the toner from adhering to the image holding member 1, it is preferred to coat the surface or the photosensitive layer with a releaser layer. Here, it should be noted that, although the image holding member 1 of the cylinder shape is used in the embodiment of FIG. 1, the present invention is not intended to be limited to this structure, and, for example, a photosensitive layer may be formed on the surface of an annular elastic belt to provide an endless belt that is placed so as to cyclically travel, and this may be used as the image holding member 1.

In this embodiment, the image holding member 1 is allowed to rotate at a circumferential velocity of approximately 40 m/s to 400 m/s in the direction of arrow shown in the drawing, and the photosensitive layer of the image holding member 1 is charged by an electrostatic charger 2. It is then selectively exposed correspondingly to an image to be formed, by an exposing device 3, so that an electrostatic latent image consisting of charged areas and areas having attenuated quantity of charge due to the exposure is formed on the image holding member 1.

The electrostatic latent image is developed by a development unit 4. The development unit 4 is provided with a receptacle containing a liquid developer and a roller-shaped developing electrode which is placed face to face with the image holding member 1 keeping out of contact. A developing voltage is applied to the developing electrode, and the liquid developer is carried to the gap between the developing electrode and the image holding member 1 by the rotation of the developing electrode.

The liquid developer is composed of an insulating liquid carrier made of a non-polar solvent and toner particles having a particle size of approximately 0.1 micron to 2 microns, dispersed in the liquid carrier. By applying a developing voltage to the developing electrode, the toner particles in the liquid developer are condensed and fixed on the photosensitive layer in association with an electrostatic latent image, thereby carrying out a developing process to form a visible image of the toner particles.

The liquid carrier on the surface of the image holding member 1 bearing the visible image formed as described above is removed by a squeeze roller 5 and a suction nozzle 6, thereby forming the visible image (toner image) in a dried state (consisting of substantially only the toner particles).

Here, it is to be noted that the squeeze roller may be connected to a power supply, as necessity arises, to provide an electric potential that allows the squeeze roller to electrostatically adsorb the toner particles on the areas not to be provided with visible image, so that it may also be used as a fog-removing means for an image. Alternatively, a fog-removing means may be installed separately from the squeeze roller.

In the image-forming process carried out in the embodiment of FIG. 1, a monochrome visible image is formed. However, it is of course possible to form a full color image. In this case, for example, a set of the charger 2, the exposing device 3, the developing device 4 and the squeeze roller 5 for developing a single color is provided three times for respective three primary colors (or four times for four colors including the three primary colors and black) and they are placed on the periphery of the image holding member 1 so that visible images of the respective colors are repeatedly formed and superposed.

As illustrated in FIG. 1, the toner image held on the image holding member 1 is then transferred onto an intermediate transfer medium 7 such as an intermediate drum, and then transferred onto a recording medium 9 such as paper that is transported in a sandwiched manner between the intermediate transfer medium 7 and a pressure member 8. Therefore, the transferring device of this embodiment comprises the intermediate transfer medium 7 for assisting the transferring of the toner image from the image holding member 1 onto the recording medium 9. However, it is also possible to omit the intermediate transfer medium 7 and press the pressure member 8 to the image holding member 1 so that the toner image is directly transferred onto the recording medium 9 from the image holding member 1. Alternatively, in place of the pressure roller 9, a discharging device such as a corona charger may be used to carry out the transferring process.

After the transferring process, residual toner tends to exist on the surface of the image holding member 1, depending on transferring conditions. The residual toner after the transferring process is removed by a cleaner unit 10, so that the sequence of steps for the image formation is completed. In a state where no toner exists on the surface of the image holding member 1, the next image forming process is carried out to produce a new image.

Figure 2:
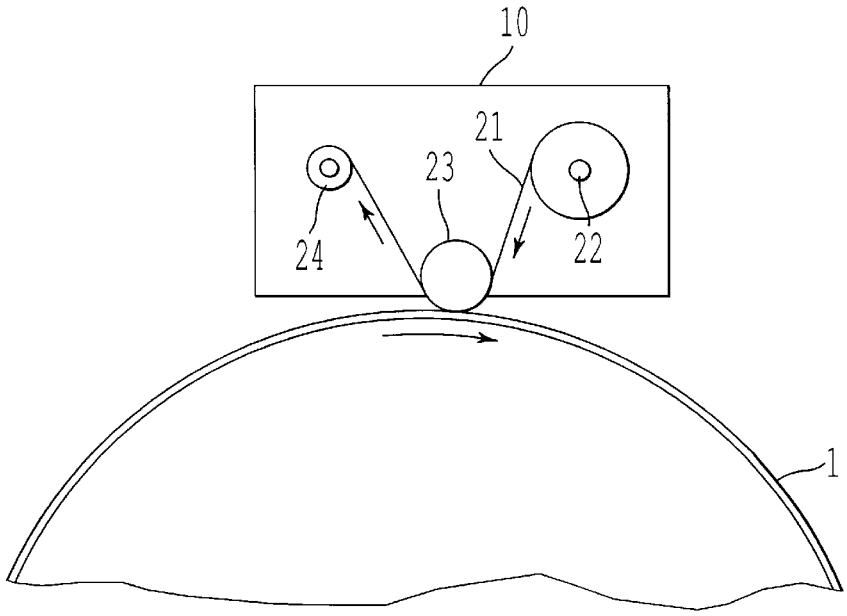
FIG. 2 is a schematic view showing the structure of a cleaner in the printing apparatus of FIG. 1.

FIG. 2 shows the cleaner unit 10 in the embodiment shown in FIG. 1 in detail.

The cleaner unit of FIG. 2 contains a belt-shaped flexible and fibrous wiping member 21 (hereinafter, referred to as a web) having a width as wide as the latent image holding member 1, a web feeding device 22 for holding the web 21 and for supplying it to the image holding member 1, a web pressing member 23 for pressing the web 21 thus supplied onto the image holding member 1, and a web winding device 24 to which the leading edge of the web 21 is connected so as to be collected and retrieved.

The web feeding device 22 is provided with a shaft made of metal on which the web 21 is wound in a roll shape, and a torque generating mechanism (not shown). The feeding amount of the web 21 by the torque generating mechanism is controllable so as to prevent distortion and twist of the web 21.

The web winding device 24 is provided with a driving device (not shown) so that the web 21, supplied from the web feeding device 22, is allowed to travel always at a preset winding speed with a fixed tension.

The web 21, which travels from the web feeding device 22 to the web winding device 24, is pressed onto the image holding member 1 by the web pressing member 23. It is preferred to use an elastic roller as the web pressing member 103. In particular, an elastic roller having a diameter of approximately 5 mm to 100 mm is more preferably used, and the hardness of the elastic roller is preferably set at 5 degrees to 80 degrees as a value determined in accordance with the hardness measuring method of the Japanese Industrial Standard A. If the hardness of the elastic roller is softer than that of 5 degrees, or if the diameter of the elastic roller is greater than 100 mm, the pressing force tends to be dispersed, resulting in a failure to provide a right contact necessary for cleaning on the cleaning surface of the web 21. On the other hand, if the hardness of the elastic roller is harder than that of 60 degrees, or if the diameter of the elastic roller is smaller than 5 mm, it becomes difficult to obtain an appropriate nip length (length of the contacting area between the photosensitive drum and the elastic roller), causing non-uniform or unstable pressing and the subsequent partial cleaning spots. With respect to the material for the elastic roller, examples thereof include silicone rubber, urethane rubber, NBR rubber, EPDM rubber, natural rubber, fluorine rubber, epichlorohydrine rubber and the like.

The pressure for pressing the elastic roller to the image holding member 1 is preferably set in the range of 50 g/cm to 5,000 g/cm. In the case of not more than 50 g/cm, it is difficult to obtain a uniform pressing process, resulting in a partially insufficient cleaning, or lack of frictional force causes entirely insufficient cleaning and the subsequent unremoved toner. The pressure greater than 5,000 g/cm gives adverse effects on the driving process of the image holding member due to an excessive torque imposed on the device, resulting in a failure to provide an accurate printing process.

In order to clean the surface of the image holding member 1 by using the web 21, it is necessary for the web 21 to relatively move with respect to the surface of the image holding member 1. In other words, the web 21 is allowed to travel at a velocity different from the circumferential moving velocity of the surface of the latent image bearing body 1. This includes a case where the web 21 is stopped and only the image holding member 1 is rotated. In view of the cleaning efficiency which has to be prevented from falling, it is necessary to gradually shift and change the cleaning surface or the portion of the web 21 contacting the image holding member 1. By taking these points into consideration, it is preferable to provide a system arrangement such that the moving direction of the surface of the image holding member 1 and the travelling direction of the web 21 are opposite to each other. Here, the travelling velocity of the web 21, exerted by the winding process thereof, is preferably set in the range of 0.05 mm/s to 5 mm/s. The travelling velocity slower than 0.05 mm/s makes the amount of toner required to be wiped by the web 21 per unit area greater than the maximum amount of toner that can be removed thereby, resulting in an insufficient cleaning process. The velocity greater than 5 mm/s increases the amount of consumption of the web 21, resulting in a bulky cleaning device and an increase in the running costs.

The web 21, which is a fibrous wiping member, is made from a fibrous material, that is, a material formed by processing fiber, such as a woven or nonwoven sheet or fabric. With respect to the kind of fiber, various fibers such as polyester, acryl, polyimide, polyamide, metal and paper fiber (cellulose fiber) can be properly used, and the fiber element is not particularly limited. In order to carry out the cleaning process, any member may be used as long as it has a fibrous material on the surface to be made in contact with the image holding member. Therefore, a plastic sheet with fibers laid on the surface thereof or a fibrous material with a backing applied thereto can also be used as the web 21.

It is preferred for the web 21 to use a fibrous material formed by processing fiber having a fiber diameter of approximately 10 microns to 200 microns. The application of fiber having a diameter exceeding 200 microns tends to cause degradation in the cleaning effect on the residual toner particles, and it makes the cleaning device bulky due to an increase in the thickness of the web. The application of fiber having a diameter not more than 10 microns is rather difficult because of the problem in the production thereof. Moreover, it is preferred to use a fiber material having a thickness in the range of 50 microns to 500 microns. The thickness less than 50 microns makes small the amount of toner particles that can be held, resulting in a reduction in the cleaning capacity for the residual toner particles, and the thickness exceeding 500 microns makes the cleaning device bulky.

In the present invention, the application of a nonwoven sheet as the web 21 is advantageous in the cleaning performance because of the following features.

When a nonwoven sheet is manufactured, portions having a higher fiber density and portions having a lower fiber density are produced, in general, with the result that the nonwoven sheet is not uniform. In many cases, the surface of the sheet has a higher fiber density, while the inside thereof has a lower fiber density. As a result, if the nonwoven sheet is used as the web 21, the surface portion of the web having a higher fiber density scrapes residual toner particles from the image holding member, and the scraped toner particles which have a particle size as small as 1/10 (i.e. about 1 micron or larger) of the fiber diameter are allowed to shift inside the web between the fibers in the thickness direction of the web, and held in the inner portions having a lower fiber thickness while checked by the portions having a higher fiber thickness. Accordingly, the inside portions having a lower fiber density serves like inner pores so that the scraped toner particles are positively held inside the web. In other words, the residual toner can be positively removed from the image holding member.

In the case when the nonwoven sheet is used as the web, it is preferable to arrange the web in such a manner that the alignment of the fibers on the surface of the web is biased to a direction which is perpendicular to the relative moving direction (first direction) of the web to the image holding member 1. This arrangement allows the fibers and the toner particles on the image holding member to properly contact each other, and also allows the toner particles to be more positively captured, thereby making it possible to shift more scraped toner particles toward the inside of the web. The effects of such a fiber alignment of the nonwoven sheet become more remarkable when the intersecting angle of the fiber is larger than 45 degrees (in other words, when the angle is smaller than 45 degrees with respect to the direction of the rotation axis (second direction or a direction perpendicular to the first direction) of the image holding member 1) with respect to the relative moving direction of the surface of the image holding member 1. In other words, a complete alignment such that all the fibers are perpendicular to the relative moving direction of the web is unnecessary. When the ratio of the fibers having an intersecting angle which is more than 45 degrees and less than 135 degrees (hereinafter, such fibers will be referred to as effective fiber) accounts for 50% to 100% on the web surface, the web effectively captures the toner particles, thereby making it possible to properly clean the image holding member 1. In the case of the ratio of the effective fibers less than 50%, the effects of the above-mentioned control on the alignment direction are not exerted sufficiently. However, it is noted that, in the case when the ratio of the effective fibers exceeds 98%, it becomes difficult to maintain the mechanical strength of the nonwoven sheet. Therefore, it is preferably set not to exceed 98%.

When a belt-shaped continuous nonwoven sheet is manufactured, the conventional manufacturing method tends to make the fibers aligned along the length direction of the belt. Therefore, it is rather difficult to obtain an nonwoven belt with the fiber alignment effective for cleaning as described above. Accordingly, in the case when the above-mentioned web is formed by using the conventional nonwoven sheet, it is necessary to adjust the fiber alignment by cutting and/or joining of the nonwoven sheets. Or, the adjustment of the fiber alignment is necessary to be properly carried out during the manufacturing process, by using, for example, a supply hopper having a lateral slit or a roller with lateral slots for supplying the fibers.

Here, the fiber alignment on the web surface can be measured, for example, by carrying out a visual observation, etc., on the surface of a photographed image obtained by an image pickup means such as a copying machine. In this time, ink, etc, may be applied to the web surface and this web is made to contact with a sheet of paper, etc., so that the resulting image can be easily observed for measurement. In the case when the deviation in the fiber lengths is large, statistical processing of the data may be carried out in accordance with the distribution of the fiber lengths to obtain the ratio or the effective fiber.

As illustrated in FIG. 1, when the liquid carrier is removed from the surface of the image holding member by the squeeze means and/or the suction nozzle, the toner particles adhere to the surface of the image holding member. Since the particle size of the toner particles of the liquid developer is as small as 0.1 micron to 2 microns, it is difficult for the fiber having a diameter of several tens microns on the web surface to completely capture the toner particles having a particle size of approximately not more than 1 microns that adhere to the surface of the image holding member without being transferred. In order to easily remove such fine toner particles, it is effective to make the web 21 impregnated with a liquid solvent having an affinity to the toner particles as a cleaning liquid. Since the cleaning liquid comes to wet the surface of the image holding member 1 when the residual toner is removed, this might be supplied to the next image-forming process. Therefore, it is preferable to select such a material that would not give adverse effects on the developing process, with respect to the liquid solvent used as the cleaning liquid. From this point of view, it is most preferable to use a cleaning liquid that has the same composition as the liquid carrier forming the liquid developer or a non-polar solvent having the same characteristics as the liquid carrier. With respect to the non-polar solvent, examples thereof include silicone solvents, hydrocarbon solvents and fluorine organic solvents.

In the case when the web 21 is formed by nonwoven sheets, the cleaning liquid supplied to the web 21 is allowed to permeate into portions having a high fiber density, thereby making it easier for the surface of the web 21 to capture the residual toner particles on the surface of the image holding member. It is also possible to accelerate the release of the toner particles from the surface of the image holding member and the shift thereof to the inside or the web 21. Thus the toner particles captured by the web 21 through the cleaning liquid are held in the portions inside the web having a low fiber density. For this reason, it becomes possible to carry out the cleaning process of the image holding member in a more positive manner.

The amount of impregnation of the cleaning liquid in the web 21 is preferably set in the range of 2 $g/m^2$ to 200 $g/m^2$. If the amount of the cleaning liquid is less than 2 $g/m^2$, it is failed to sufficiently obtain the above-mentioned effects by the cleaning solution. If the amount thereof exceeds 200 $g/m^2$, it tends to cause dripping of the cleaning liquid from the web or to supply an excessive amount of the cleaning liquid to the image holding member 1, resulting in adverse effects on the next image-forming process.

EXAMPLES

Example 1

The following operations were carried out by using a wet-type printing apparatus having the structure as shown in FIG. 1.

In the printing apparatus, the image holding member 1, which was provided with a photosensitive drum having a positively chargeable photosensitive layer made from amorphous silicon, was rotated at a circumferential velocity of 80 mm/s. After uniformly charging the photosensitive layer to 800 V by a scorotron charger 2, it was subjected to exposure by an image-modulated laser beam generated from the exposing device 3. Thus an electrostatic latent image containing a character image having a print rate of 5% was formed on the surface as a test pattern. The electric potential after the exposure was 150 V.

The electrostatic latent image was formed into a visible image by the developing device 4 containing a liquid developer. The developing roller in the developing device 4, made of metal, was placed with a gap of 150 microns from the image holding member, and a developing bias voltage of 500 V was applied to the developing roller, with the developing roller being rotated at a circumferential velocity of 300 mm/s in a manner so as to allow the surface or the image holding member and the surface of the developing roller to travel in the same direction. After the developing process, the carrier liquid on the image holding member was removed by a squeeze roller made of metal in a squeeze device 5. At this time, a bias electric potential of 200 V was applied to the squeeze roller so as to serve as a fog-removing means. Here, the squeeze roller was placed with a gap of 100 microns from the image holding member, and rotated at a peripheral velocity of 250 mm/s in a maimer so as to allow the surface of the image holding member and the surface of the squeeze roller to travel in the directions opposite to each other. Thus a toner image was formed on the image holding member as a test pattern.

Moreover, after residual liquid carrier had been removed by the suction nozzle 6, the toner image was transferred onto an intermediate transfer medium 7. The intermediate transfer medium 7, which was a roller having an elastic layer on the surface thereof, had a heating device being provided inside thereof for heating and imparting melt viscosity to the toner particles coming into contact therewith so as to improve the transferring efficiency, and the surface of the roller was maintained at 80 degrees centigrade.

The toner image formed on the surface of the image holding member was transferred onto the intermediate transfer medium 7, and further transferred onto a plain A-4 size paper sheet serving as the recording medium 9 that was supplied between the intermediate transfer medium 7 and the pressure member 8.

Thereafter, a cleaner unit 10 as shown in FIG. 2 was used so as to clean residual toner after the transferring process from the surface of the image holding member 1 that had been subjected to the transferring process. The web 21 of the cleaner unit 10 was made from a nonwoven sheet having a thickness of 0.3 mm formed by molding polyester fiber having an average fiber diameter of 14 microns.

Here, a copied image of the nonwoven sheet was obtained by a copying machine, and the degree of alignment of the fibers in this image was visually measured. As a result, it was found that the ratio of the fibers that had an angle smaller than 45 degrees with respect to the direction of the rotation axis of the image holding member was 80%, which formed a substantially laterally-aligned nonwoven sheet that was oriented in a direction perpendicular to the feeding direction of the web.

With respect to the web pressing member 23 used was a roller made from silicone rubber having a diameter of 20 mm with a hardness of 20 degrees according to the JIS A. The pressing pressure of the roller was set to 500 g/cm, and the web feeding device 22 and the web winding device 24 were adjusted so as to set the web feeding velocity at 0.5 mm/s. Here, the web traveling direction was set so as to be opposite to the circumferential moving direction of the surface of the image holding member 1.

Moreover, a static eliminating lamp which generated an LED light beam, not shown in FIG. 1, was utilized to make uniform the surface electric potential of the image holding member 1 so that the surface of the electrostatic image holding member 1 was returned to its initial state. The above-mentioned sequence of the image-forming steps was repeated 1,000 times to produce copies of the test pattern on 1,000 plain paper sheets of A-4 size.

The resulting character images of the test patterns were evaluated, and no toner particles existed on non-image portions (white portions) from the initial image to the last image; thus, it was confirmed that the residual toner particles had been removed by the cleaning device.

Example 2

The same operations as those of example 1 were repeated to carry out image outputs of 1,000 sheets, except that the feeding velocity of the web 21 was set to 0.25 mm/s and that the web 21 was impregnated with a cleaning solution of 5 g/cm$^2$. With respect to the cleaning liquid, a non-polar solvent (manufactured and sold by Exxon Co. with the trade name, "Isopar L") that was the same as the liquid carrier of the liquid developer.

The resulting images were evaluated in the same manner as example 1, and no toner particles existed on non-image portions (white base portions). Thus it was confirmed that the residual toner particles had been removed by the cleaning device.

Here, it was also possible to reduce the consumption of the web by making the feeding velocity of the web 21 lower than that of example 1, while the residual toner particles were effectively removed.

Example 3

The same operations as those of example 1 were repeated to carry out image outputs, except that a nonwoven sheet in which the ratio of the fibers that had an angle smaller than 45 degrees with respect to the direction of the rotation axis of the image holding member 1 was 20% was used.

The resulting images were evaluated, and although no adhesion of toner particles was observed in non-image portions on images at the initial outputs, the non-image portions were thinly colored on the 100th image, and the character image became difficult to read on the 500th image and thereafter. This shows that the residual toner particles were gradually accumulated due to the repetition of image outputs, causing increased coloring on the non-image portions.

Moreover, in the case when the same image output was repeated except that the cleaner unit 10 was adjusted so as to set the web feeding velocity at 6 mm/s, no toner particles existed on non-image portions (white portions) from the initial image to the last image in the same manner as example 1.

Comparative Example 1

The same operations as those of example 1 were repeated to carry out image outputs, except that, in place of the nonwoven sheet, an elastic blade made of urethane rubber having a thickness of 5 mm and a hardness of 62 degrees according to the JIS A hardness standard was used, with the edge portion of the blade being pressed onto the image holding member by a pressure of 120 g/cm.

The resulting images were evaluated. As a result, it was found that the non-image portions were thinly colored on the second image and thereafter, and the character image became difficult to read on the 10th image and thereafter.

As described above, in a printing apparatus using a liquid developer such as a wet-type electrophotographic apparatus, the present invention makes it possible to more positively execute the cleaning process on the image holding member in a simple manner, and consequently to achieve a printing apparatus having a longer duration of life.

The printing apparatus described in the above embodiment is of course usable as a printing or recording system in a variety of printers, plain paper copiers, facsimile machines and the like.

The present disclosure relates to subject matter contained in Japanese Parent Application No. 2000-199938, filed on Jun. 30, 2000, the disclosure of which is expressly incorporated herein by reference in its entirety.

It must be understood that the invention is in no way limited to the above embodiments and that many changes may be brought about therein without departing from the scope of the invention as defined by the appended claims.

What is claimed is:

1. A printing apparatus for printing an image onto a print medium with use of a liquid developer which contains a liquid carrier and a toner being dispersed in the liquid carrier, comprising:

an image holding member having an imaging surface on which a latent image corresponding to the image to be printed is generated;

a development unit which provides the liquid developer to the imaging surface to form a toner image corresponding to the latent image;

a transfer member which transfers the toner image from the imaging surface to the print medium; and a fibrous wipe member having a cleaning face contacting with the imaging surface for wiping a residual toner failing to be transferred from the imaging surface, by moving relatively to the imaging surface in a first direction, wherein a cleaning liquid is impregnated at a ratio of 2 grams per square meter to 200 grams per square meter in the fibrous wipe member.

2. The printing apparatus of claim 1, wherein the fibrous wipe member is formed of a flexible nonwoven fabric.

3. The printing apparatus of claim 1, wherein the fibers of the cleaning face have a fiber diameter of 10 microns to 200 microns.

4. The printing apparatus of claim 1, wherein the fibrous wipe member has a thickness of 50 microns to 500 microns.

5. The printing apparatus of claim 1, wherein the fibrous wipe member is formed of a fibrous material selected from the group consisting of polyester fiber, acrylic fiber, polyamide fiber, metal fiber and cellulose fiber.

6. The printing apparatus of claim 1, wherein the cleaning liquid is substantially the same as the liquid carrier of the liquid developer.

7. The printing apparatus of claim 1, further comprising:

a carrier remover which removes the liquid carrier from the toner image formed on the imaging surface before the toner image is transferred from the imaging surface.

8. A printing apparatus for printing an image onto a print medium with use of a liquid developer which contains a liquid carrier and a toner being dispersed in the liquid carrier, comprising:

an image holding member having an imaging surface on which a latent image corresponding to the image to be printed is generated, wherein the image holding member comprises:

an electroconductive drum;

a photosensitive layer being provided on the circumference of the electroconductive drum to form the imaging surface on the photosensitive layer; and a rotary mechanism which rotates the electroconductive drum to move the imaging surface;

a development unit which provides the liquid developer to the imaging surface to form a toner image corresponding to the latent image;

a transfer member which transfers the toner image from the imaging surface to the print medium; and a fibrous wipe member having a cleaning face contacting with the imaging surface for wiping a residual toner failing to be transferred from the imaging surface, by moving relatively to the imaging surface in a first direction, wherein the imaging surface is arranged to move in the direction opposite to the first direction at a position of contact with the cleaning face at a circumferential velocity of 40 meters per second to 400 meters per second.

9. The printing apparatus of claim 8, further comprising:

an electrostatic charger which charges uniformly the photosensitive layer; and an exposure which selectively exposes the charged photosensitive layer correspondingly to the image to be printed to generate the latent image on the imaging surface.

10. A printing apparatus for printing an image onto a print medium with use of a liquid developer which contains a liquid carrier and a toner being dispersed in the liquid carrier, comprising:

an image holding member having an imaging surface on which a latent image corresponding to the image to be printed is generated;

a development unit which provides the liquid developer to the imaging surface to form a toner image corresponding to the latent image;

a transfer member which transfers the toner image from the imaging surface to the print medium;

a fibrous wipe member having a cleaning face contacting with the imaging surface for wiping a residual toner failing to be transferred from the imaging surface, by moving relatively to the imaging surface in a first direction, wherein the fibrous wipe member has an elongate belt shape and is disposed to extend along the first direction at a position of contact with the imaging surface; and a face shift mechanism which shifts the cleaning face contacting the imaging surface from one area of the surface of the fibrous wipe member to another area, wherein the face shift mechanism continuously shifts the cleaning face at a rate of 0.05 millimeters per second to 5 millimeters per second.

11. The printing apparatus of claim 10, wherein the face shift mechanism comprises:

a cleaning feeder which feeds the fibrous wipe member to the position of contact with the imaging surface; and a cleaning retriever which retrieves the fibrous wipe member from the position of contact with the imaging surface.

12. A printing apparatus for printing an image onto a print medium with use of a liquid developer which contains a liquid carrier and a toner being dispersed in the liquid carrier, comprising:

an image holding member having an imaging surface on which a latent image corresponding to the image to be printed is generated;

a development unit which provides the liquid developer to the imaging surface to form a toner image corresponding to the latent image;

a transfer member which transfers the toner image from the imaging surface to the print medium;

a fibrous wipe member having a cleaning face contacting with the imaging surface for wiping a residual toner failing to be transferred from the imaging surface, by moving relatively to the imaging surface in a first direction; and a pressure member which presses the cleaning face to the imaging surface at a pressure of 50 grams per centimeter to 5,000 grams per centimeter.

13. The printing apparatus of claim 12, wherein the pressure member comprises an elastic roller having a hardness of 5 degrees to 60 degrees according to hardness measurement of Japanese Industrial Standard A.

14. The printing apparatus of claim 13, wherein the elastic roller has a diameter of 5 millimeters to 100 millimeters.

* * * * *